US006107976A

United States Patent [19]

Purinton

[11] Patent Number: 6,107,976

[45] Date of Patent: Aug. 22, 2000

[54] HYBRID CORE SANDWICH RADOME

[75] Inventor: Donald L. Purinton, Plano, Tex.

[73] Assignee: Bradley B. Teel, Carrollton, Tex.

[21] Appl. No.: 09/275,992

[22] Filed: Mar. 25, 1999

[51] Int. Cl.[7] ..... H01R 1/42

[52] U.S. Cl. ..... 343/872

[58] Field of Search ..... 343/872, 873; 264/257; 428/66, 117; H01Q 1/42

[56] References Cited

U.S. PATENT DOCUMENTS

| | | | |
|---|---|---|---|
| 4,061,812 | 12/1977 | Gilwee, Jr. et al. | 428/117 |
| 4,780,262 | 10/1988 | VonVolkli | 264/512 |
| 5,323,170 | 6/1994 | Lang | 343/872 |
| 5,344,685 | 9/1994 | Cassell | 343/872 |
| 5,408,244 | 4/1995 | Mackenzie | 343/872 |
| 5,662,293 | 9/1997 | Hower et al. | 244/133 |
| 5,738,750 | 4/1998 | Purinton et al. | 156/325 |
| 5,849,234 | 12/1998 | Harrison et al. | 264/257 |

*Primary Examiner*—Don Wong
*Assistant Examiner*—Hoang Nguyen
*Attorney, Agent, or Firm*—Duke W. Yee; Carstens, Yee & Cahoon, L.L.P.; Rudolph J. Buchell

[57] ABSTRACT

The present invention provides for a heretofore unknown radome construction which utilizes core materials heretofore unrealized in radome construction. These core materials include a class of microcellular foams and polycarbonate honeycomb. In one embodiment, the polycarbonate honeycomb is configured with a circular shaped primary cell structure. In another embodiment, the radome is fashioned as a hybrid core configuration consisting of an impact resisting core material and a conventional core material. In another embodiment, the impact resisting core is positioned at the forward nose section of the radome while the conventional core material is positioned in the aft section of the radome.

51 Claims, 9 Drawing Sheets

HYBRID CORE SANDWICH RADOME

BACKGROUND OF THE INVENTION

1. Technical Field

This invention generally relates to radomes. More particularly, the invention relates to impact resistance radomes.

2. Description of the Related Art

The word "radome" dates back to World War II and is derived from the words 'radar' and 'dome.' Originally, radome referred to radar transparent, dome-shaped structures used to protect radar antennas on aircraft. Over time, radome has come to mean almost any structure that protects a device, such as a radar antenna, that sends or receives electromagnetic radiation, such as that generated by radar, and which is substantially transparent to the electromagnetic radiation. The structure may be flat rather than dome-shaped and may be on an aircraft, the ground or a ship.

The term "radome" as used herein in its various grammatical forms identifies any structure used to protect electromagnetic radiation equipment, e.g., radar equipment, that is aircraft, ground or ship based, unless a specific radome, e.g., or a nose radome of an aircraft, is identified.

A radome is an integral part of a radar system because the thickness of the radome and its properties determine the effectiveness of the radar and must be compatible with the specific properties of the radar set. Major design criteria of a radome include electromagnetic radiation transparency, structural integrity, environmental protection, e.g., protection from rain erosion and lightning strikes, and, especially for aircraft, an aerodynamic shape and light weight. Economics also require that the cost should be as low as possible and the service life as long as possible. Successful radome design must balance all of the conflicting requirements. For example, the ideal shape of a nose radome for an aircraft from an electromagnetic radiation standpoint is hemispherical and as large as the aircraft will allow. A better aerodynamic shape, however, is ogival. A thick radome wall would have structural benefits, yet for optimum electromagnetic transmission the wall thickness must be chosen as a factor of radar wavelength. A thin, lightweight design may improve aircraft performance, save fuel and reduce material cost but at the expense of decreased service life, increased maintenance costs and/or increased product costs. Clearly, tradeoffs must be made.

Currently, a common type of radome is one having a fiberglass reinforced honeycomb core sandwich construction. The honeycomb core has an open-cell structure that encourages moisture intrusion that, as discussed below, can destroy the radome, and it has relatively poor impact resistance.

Static properties, finite element analysis (FEA), and testing traditionally have led aircraft designers to select the honeycomb core to construct the "best" radome. Although "best" is often defined as the lightest, stiffest and strongest core having the required electromagnetic properties, this approach is often inadequate, especially in impact/moisture critical environments, such as nose radomes and ship borne radomes. Radome repair data accumulated by the United States Federal Aviation Administration (FAA) indicate that about 85% of all honeycomb radomes are removed for moisture damage, and most air carriers confirm that their mean time-between-failures is substantially less than two years for some honeycomb radomes. That is to say, high maintenance costs, large inventory and questionable radar performance (due to moisture) occur.

Radomes fail when subjected to severe structural damage or degradation from electromagnetic radiation transmission. There are numerous ways for failure to occur in the hostile environment in which radomes must operate. Static electricity can cause microscopic pinholes or microcracks in a protective skin that covers the core. Lightning strikes on the outer surface of the radome can arc between the outer surface and the antenna or another electrically conductive surface to burn through the radome. Static burns are small, about the size of a pinhole or microcrack. High velocity rain or hail can cause skin laminate and core impact failure or "soft spots" in the radome which promote microcracking. Pinholes and microcracks are paths for moisture to enter the radome core. Rain or moisture causes further damage as it penetrates into the core through the pinholes, or microcracks. During the flight of an aircraft, dynamic wind pressure pumps water through the pinholes, or microcracks, deeper into the core.

Moisture in the core causes severe problems, especially if altitude or temperature changes result in multiple freeze/thaw cycles. The volume of this water expands by about 10% when it freezes causing it to exert a force against the core and skin. Repetitive freezing and thawing results in delamination, cracking and the like in the core that results in additional moisture paths and, if severe enough, radome failure. Water and ice are also detrimental to electromagnetic radiation transmission as their dielectric constant is on the order of 20 times greater than that of most materials used for sandwich construction radomes.

Another common type of radome used in aircrafts is the fluted core radome, which was adopted to combat the moisture problem associated with the honeycomb core radome. The fluted core is a series of square fiberglass tubes. Hot air is sometimes blown into the tubes to de-ice the radome and blow water away from the region of the radome where electromagnetic transmission is critical. The fluted core has an undesirably high density (approximately 200 $kg/m^3$), which is more than twice as dense as other radome core materials. A fluted core radome also weighs approximately 30% more than its honeycomb counterpart. The construction of a fluted core radome is very labor intensive, which leads to an expensive finished product. Furthermore, repairs are expensive and time consuming. These disadvantages are not acceptable to many radome users, especially since fluted core radomes eventually retain moisture in any event.

Yet another type of radome is the foam core radome. Radomes that used polyurethane foam were popular in the 1950s, but the foam's tendency to crumble and its poor fatigue and impact properties quickly gave "foam radomes" an unfavorable reputation. Other foams that allegedly are closed-cell, e.g., polymethacrylimide foam, may actually have poor moisture absorption properties. This history of poor "foam radome" performance has hindered the development of other radomes using a better suited foam.

The use of a syntactic foam, i.e., foam containing glass microballoons, in radomes is limited because the syntactic foam radomes are heavier than honeycomb radomes.

Therefore, it would be advantageous to have a radome that overcomes one or more of the aforementioned shortcomings.

SUMMARY OF THE INVENTION

The present invention provides for a heretofore unknown radome construction which utilizes core materials heretofore unrealized in radome construction. These core materials include a class of microcellular foams and polycarbonate honeycomb. In one embodiment, the polycarbonate honeycomb is configured with a circular shaped primary cell structure is used as the radome core material. In another embodiment, the radome is fashioned as a hybrid core configuration consisting of an impact resisting core material and a conventional core material.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Although this invention is acceptable for embodiment in many different forms, presently preferred embodiments of the invention are described in detail herein. It should be understood, however, that the present disclosure is to be considered as an exemplification of the principles of this invention and is not intended to limit the invention to the embodiments described.

Radome 100 is a nose radome positioned at the front of an aircraft, such as a Boeing 727 or 737. While this is the conventional radome location for commercial aircraft, it should be understood that the scope of the invention is not limited to aircraft nose radomes. The present invention is equally well suited for use in other radome applications, for example, radomes located in the rear or tail of an aircraft, radomes located under the fuselage, or radomes that are ground-based. For convenience only, the remainder of the discussion is directed to the aircraft nose radome, although it should be understood that the principles of the invention are useful for any type of radome.

Figure 1:
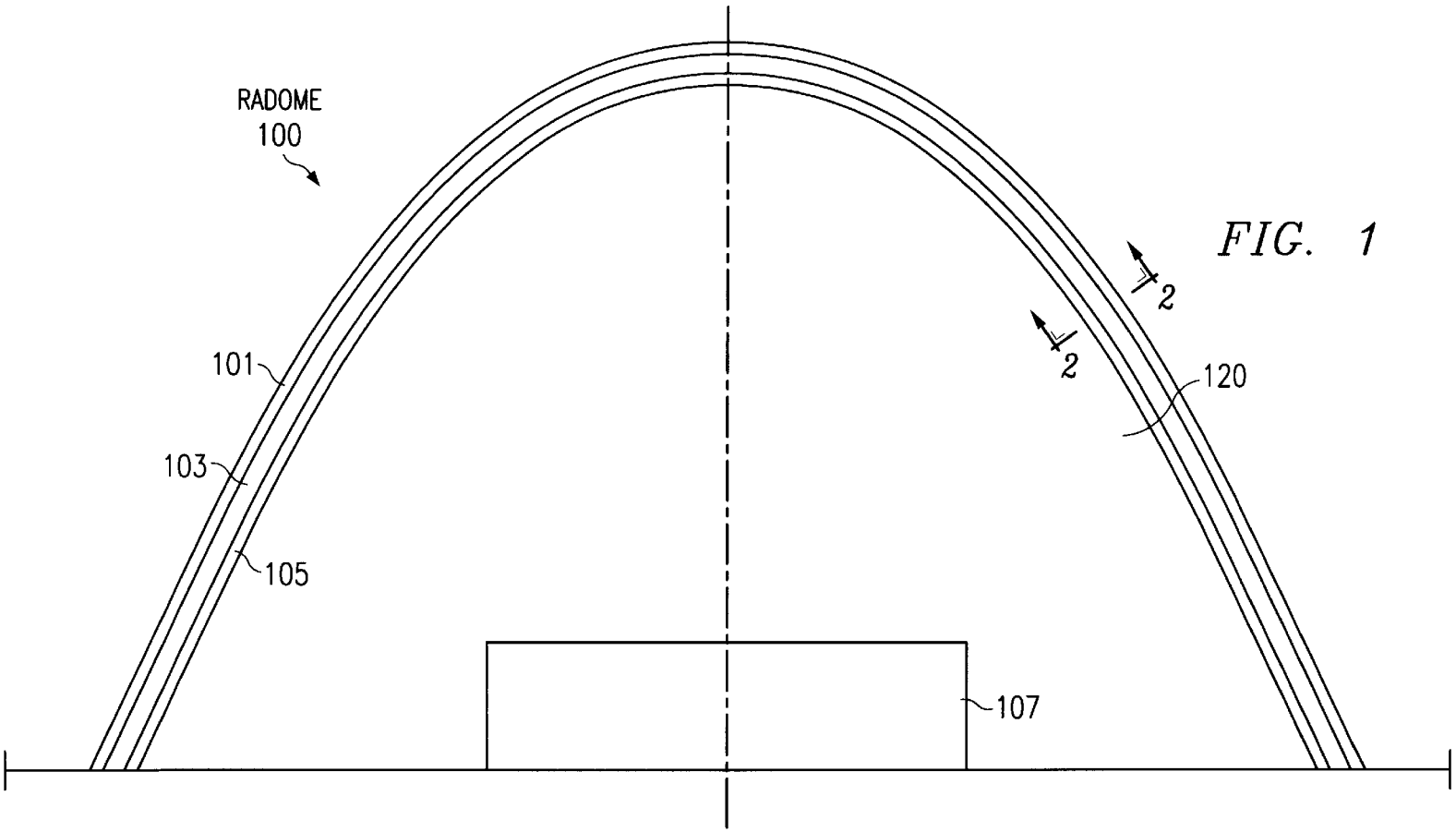
FIG. 1 illustrates a radome of the preferred embodiment wherein a core layer is constructed of an imidized polymer foam (polyimide foam) and covered with a skin layer.

FIG. 1 illustrates a radome 100 which is made of polyimide foam, preferably used as core layer 103, covered with skin 101. The polyimide foam in core layer 103 is the core of radome 100. Radome 100 defmes cavity 120 that receives and protects electromagnetic equipment within, separated from the polyimide foam of core layer 103 by a second layer 105. A radar antenna is a representative piece of electromagnetic equipment.

Figure 2:
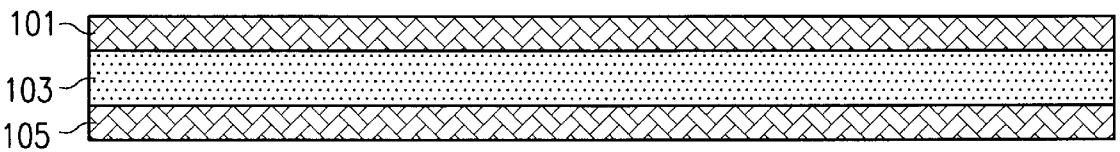
FIG. 2 illustrates a cross section of the preferred radome taken along line A–A' of FIG. 1.

FIG. 2 illustrates a cross section of radome 100 taken along line A–A' of FIG. 1. Skin 101 is an exterior surface to polyimide foam core layer 103. Also shown is a second skin 105 which, in this case, is the interior skin.

Figure 3:
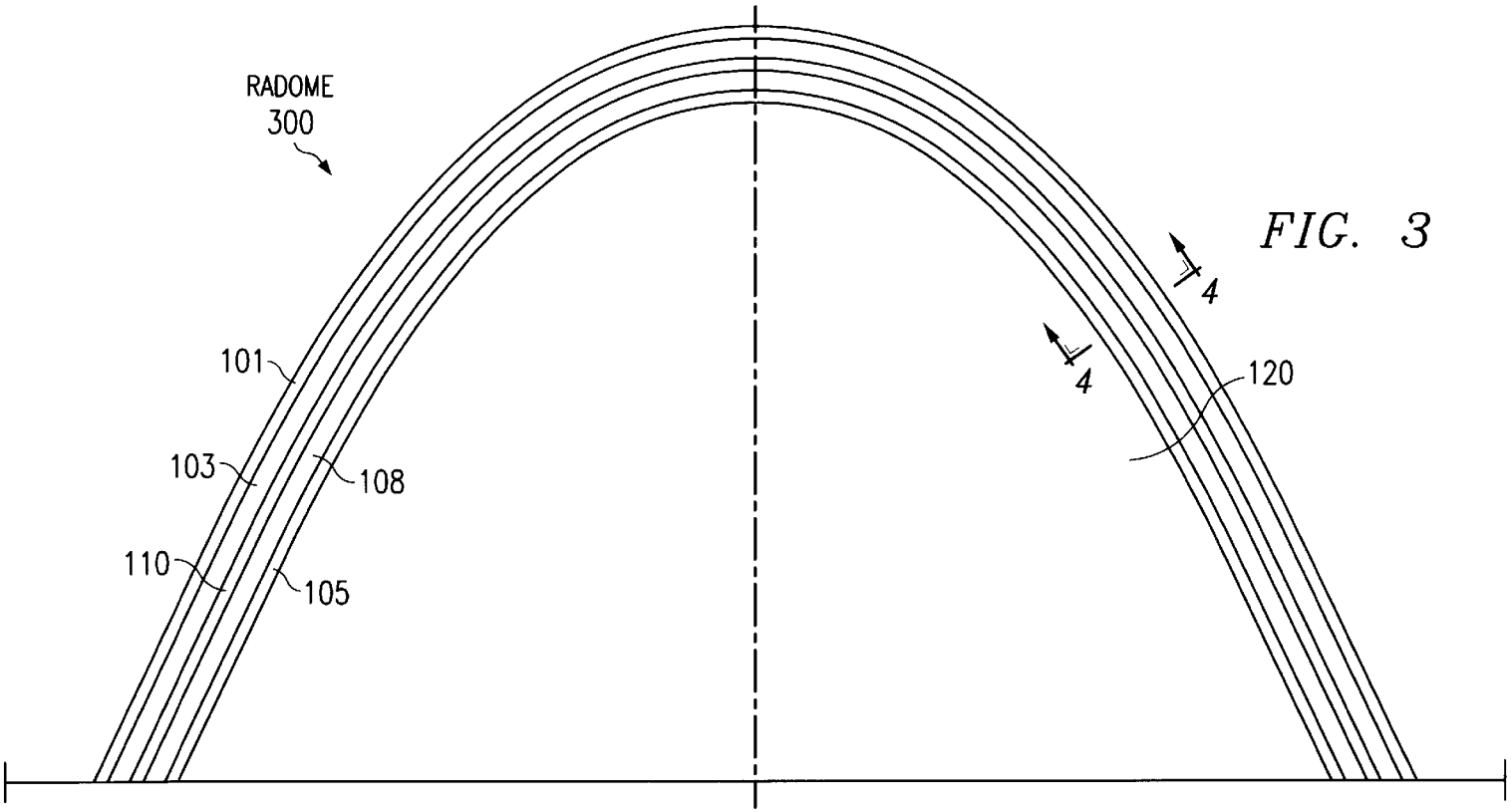
FIG. 3 illustrates another embodiment of the radome, wherein the radome comprises a laminate of two imidized polymer foam (polyimide foam) core layers, an intermediate skin, an exterior skin, and an interior skin.

In another embodiment illustrated in FIG. 3, radome 300 is a laminate made of two polyimide foam core layers 103 and 108, an intermediate skin 110, and two skin layers, i.e., exterior skin 101 and interior skin 105, sandwiching adjacent core layers 103 and 108.

Figure 4:
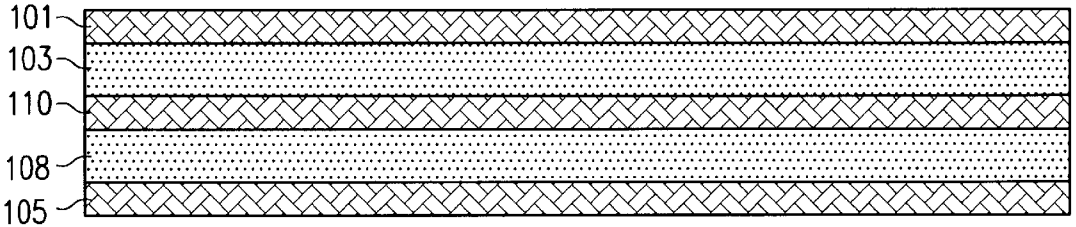
FIG. 4 shows cross section B–B' of the radome in FIG. 3.

FIG. 4 shows cross section B–B' of radome 300 as described above in connection with FIG. 3.

The polyimide foam is rigid or semi-rigid and, preferably, is a closed-cell foam. In a closed-cell foam, each cell is entirely surrounded by a cell wall which inhibits the flow of fluids through the foam. In contrast, an open-cell foam has individual cells that are not completely surrounded by cell walls, allowing fluid to pass between adjacent cells.

The cells of the polyimide foam preferably have a diameter in the range of about 0.5 to about 1 millimeters. The density of the polyimide foam is preferably in the range of about 75 to about 150 kilogram/$m^3$.

The polyimide foam has a relatively high glass transition temperature, which makes it well suited for high temperature applications, such as those generated by high performance military aircraft. Preferably, the glass transition temperature is at least about 350° F.

The impact resistance of the polyimide foam is preferably in the range of about 1 to about 2 kilojoules/$m^2$. The average dielectric constant of the preferred polyimide foam is less than 1.4. The loss tangent of same is less than 0.02, preferably less than 0.007.

The polyimide foam is prepared by a conventional synthesis that, for example, reacts aromatic diamine functionality with an aromatic carboxylic acid functionality. Alternatively, the aromatic carboxylic acid functionality can be in its ester or anhydride form. When the polyimide is a polyetherimide, the foam is produced by a nucleophilic reaction between a phenolic salt functional group and a halo and/or nitro functionality.

Thermoplastic polyimide foams are believed to be useful herein. Note that the group of polyimide foams include two sub-groups, thermoset polyimide foams and thermoplastic polyimide foams of which the former has proven to have virtually no practical value in radome construction. This sub-group includes representative thermoset polyimide foams which include thermoset polyimide foams bismaleimides, acetylene-terminated polyimides, benzocyclobutene-terminated polyimides, poly-bis (allylnadic) imides and PMR-polyimides.

The thermoplastic polyimide foams, which have proven to be very useful in radome construction, generally referred to as imidized thermoplastic polymers or imidized thermoplastic polymides, technically are polyimides. These foams include representative foams such as polymers thermoplastic polyimide foams Skybond/Pyralin class (developers include Monsanto Company, St. Louis, Mo. and E. I. duPont de Nemours & Co. Inc. located at 1007 Market Street, Wilmington, Del. 19898.), Avimid class (developed by I. E. duPont), fluorinated polyimides (developers include TRW, Inc. located at 1900 Richmond Road Cleveland, Ohio and Ethyl Corporation located at P.O. Box 2189 Richmond, Va. 23218), LaRC-TPI (developed by NASA located at 7121 Standard Drive Hanover, Md. 21076-1320), Matrimid class (developed by Ciba-Geigy Corp., Ardsley, N.Y.), polyetherimides (Ultem™ from General Electric Company, Pittsfield, Mass.), and polyamideimides (Torlon developed by Amoco Performance Products, Inc.,). Similar polyimide foams and mixtures of polyimide foams are also suitable. Again, the preferred polyimide foam (imidized thermoplastic polymer) is the polyetherimide foam. A commercially available polyetherimide foam is R82.110 from Airex AG, located in Switzerland.

To achieve the desired shape of the radome, the polymide (imidized thermoplastic polymer) foam is pre-made, e.g., in sheet form, and then formed into shape, as by thermoforming, during radome production. Alternatively, the polymide (imidized thermoplastic polymer) foam is produced in-situ, as by injection molding or spraying during radome production.

The skin(s) is conventional. Suitable skins are composites of a polymer and fiber reinforcement, e.g., a pre-preg. A pre-preg is a fiber reinforced mat, e.g., a woven fiberglass cloth, pre-impregnated with a polymer, e.g., an epoxy, that cures or hardens. One or more pre-preg layers are used to make a skin. The orientation of the fibers of successive layers of a pre-preg are arranged to optimize the mechanical properties of the radome.

Two representatives of pre-preg are conventional cyanate ester/epoxy fiberglass pre-pregs: 5575-2 cyanate ester resin/4581 Astroquartz III commercially available from Cytec, Anaheim, Calif.; and 7701 epoxy resin/7781 glass, commercially available from ICI Fiberite Molding Materials by ICI Composites Inc. of Winona, Minn.

To facilitate bonding of the skin and polymide (imidized thermoplastic polymer) foam, an optional adhesive layer may be positioned therebetween. The adhesive resin is compatible with the resin of the pre-preg, and often both are the same resin. Under pressure and elevated temperature, the adhesive permeates into the top layer of the foam to enhance bonding. The adhesive is optional when the pre-preg contains sufficient resin to permeate the foam.

Representative adhesives are AF 143-2 epoxy adhesive, commercially available from 3M, Minneapolis, Minn.; and M2555 cyanate ester adhesive, commercially available from Cytec Industries Inc., Five Garret Mountain Plaza West Paterson, N.J. 07424; and the like, as used in the pre-preg.

A radome of the present invention was constructed according to the following procedure.

A male side of a mold was sanded smooth and conventionally prepared. A pin router was used to machine the 0.5 inch-thick polyetherimide foam panel, commercially available from Cytec under the designation R82.110, to a thickness of 0.18 inches. Enough foam was cut to form two new pieces having the same shape as a form used to estimate the area where the lay-up on the mold will take place. Two sheets of the polyetherimide foam were formed into shape with one sheet to be used to make the inner core and the other the outer core of a C-sandwich. Four layers of a cyanate ester/epoxy pre-preg were laid up using a 0°/90°/90°/0° fiber orientation pattern. That is, the first and fourth layers had the same orientation; the middle, second and third layers were identically oriented; and the second and third layers were rotated 90° from the orientation of the first and second layers.

Vacuum debulking was used as necessary. A layer of AF 143-2 adhesive, commercially available from 3M, was applied to the pre-preg layers. The pre-pregs and adhesive layer were then vacuum debulked. One of the formed polyetherimide foam sheets was then laid in position. The mold, pre-preg layers, adhesive layer, and polyetherimide foam layer were bagged with no bleeding, followed by curing in an autoclave at a temperature of 350° F. +/−10° F. using a temperature ramp rate of about 5° to about 10° F. per minute, a pressure of 20 +/−5 pounds per square inch and full vacuum within the bag for a time period of about three hours once the cure temperature was reached.

Cool down was performed at the rates of about 5° to about 10° F. per minute. The pressure and vacuum were not released until the temperature reached ambient, about 75° F. Then, one layer of the AF143-2 adhesive was applied followed by vacuum debulk. Ten layers of the cyanate ester/epoxy pre-preg were laid thereon using a +45°/−45°/0°/90°/0°/0°/90°/0°/−45°/+45° pattern with a vacuum debulk being performed after every three layers. A layer of the AF143-2 adhesive was then applied followed by vacuum debulk.

Then, the second formed sheet of the polyetherimide foam was applied. Curing was then performed using the above-described conditions and procedure. Then, a layer of the AF143-2 adhesive was applied followed by vacuum debulk. Three layers of the cyanate ester/epoxy pre-preg were laid thereon using a 0°/90°/0° pattern followed by vacuum debulking. Cure was then effected using the above-identified conditions.

Divinycell™ Foam Radome Embodiment

The polymide (imidized thermoplastic polymer) foam discussed above is rigid or semi-rigid and, preferably, is a closed-cell foam. Using another class of foams, a core is formed of a rigid material at an elevated temperature. Alternatively, the core is formed of a semi-rigid material in which the foam is formed at room or ambient temperature. The temperature of formation is dependent on factors such as the type of foam utilized and the density of such foam. For example, a foam having a higher density will usually require a higher temperature of formation. In this other class of foams, the core is a rigid, closed-cell foam consisting of a polymeric alloy of a cross-linked aromatic polyamide-urea and a linear vinyl polymer. This product is commercially available and sold under the trademark Divinycell™.

As illustrated in FIGS. 1 and 2, the present invention includes radome 100. Radome 100 preferably comprises an outer skin 101, a foam core layer 103, and an inner skin 105, formed in a laminated construction as described above as is conventional in the art. Radome 100 covers and protects the radar set contained therein and situated in cavity 120.

Vinyl chloride foams such as Divinycell™ are extremely rigid and, under normal uses, provide sufficient structural integrity with only an exterior skin. FIG. 2 represents a cross-sectional view of a first embodiment in which radome 100 covers and protects a radar set contained within cavity 120. The difference between the present example and the previous embodiments described above is the substitution of a rigid, closed-cell foam consisting of a polymeric alloy of a cross-linked aromatic polyamide-urea and a linear vinyl polymer, such as Divinycell,™ in place of the polymide (imidized thermoplastic polymer) foam. Another foam which provides similar results is Rohacell™ (polymethacrylimide) from Rohm Teca.

Vinyl rigid or semi-rigid foam core radomes have a greater resistance to both single and multiple impacts when compared to the commonly used honeycomb structure. As a result, the higher impact strength means moisture paths are much less likely to be created and, thus, the structural integrity of the radome will remain intact.

It is known that sandwich stiffness is an important design criteria for nose radomes. This is attributable to the sandwich construction providing improved strength characteristics without the addition of much weight. Since radomes generally have large length-to-thickness ratios, the skin and sandwich thicknesses are often far more important than core properties in determining sandwich and radome stiffness. To provide the desired structural integrity, the foam in core layer 103 has a density in the range of about 65–160 kg/m$^3$. Preferably, the foam in core layer 103 has a density of approximately 110 kg/m$^3$, which is structurally sufficient. Other radomes, such as the 737-style radomes by comparison, are generally constructed with 64 kg/m$^3$ density fiberglass honeycomb and 80 kg/m$^3$ density Nomex® flex core in the nose.

While honeycomb and flex core possess sufficient static properties, such as density and strength and modulus, vinyl rigid or semi-rigid foam cores, such as Divinycell™, have superior environmental properties including water absorption and shear strain, i.e., impact strength.

The process described below varies slightly from that described above with respect to the polymide (imidized thermoplastic polymer) foam core embodiment and will not be discussed in as much detail. Each of the outer and inner skin layers of the radome are formed of fiber reinforced plastic pre-preg. When the pre-preg is ready for use, it is subjected to heat to allow curing of the product. One or more plies or layers is used in each skin. The thickness of the outer or inner skin layer is thus dependent on the number of plies used to form the skin layer. In one embodiment, each of the inner and outer layers is a four-ply skin. In another embodiment, the inner skin consists of three plies.

To manufacture the radome, the outer skin is placed on an inner surface of a female lay-up mold as opposed to the male mold process used above. The foam core is preformed and then inserted onto the outer skin, which is sticky. A bagging film (formed of high temperature-resistant plastic) is then placed onto the foam core. The mold is then cured while a vacuum removes air from between the bagging film and the outer skin, thus laminating the foam core to the outer skin. After the curing step, the bag is removed and the inner skin is placed onto the foam core. The above steps are then repeated to create the final product. A one-stage process may also be used (such that the layers 101, 103 and 105 are laminated at one time) if significantly high enough temperatures and pressures can be achieved (e.g., through use of an autoclave).

Honeycomb Radome Embodiment

FIGS. 1 and 2 also illustrate a honeycomb core radome embodiment used in the present invention. Rather than using a polymer foam core, a fiberglass or Nomex® fiber (E.I. duPont,) honeycomb can be used in core layer 103. Radome 100 preferably comprises an outer skin 101, an open cell honeycomb in core layer 103, and an inner skin 105 formed in a laminated construction as described above and as is conventional in the art. Radome 100 covers and protects the radar set contained therein and situated in cavity 120. Fiberglass honeycomb provides excellent stiffness and weight-to-strength ratios.

Standard hexagonal fiberglass honeycomb open-cell configuration, while stiff and strong, possesses some undesirable qualities not described above, the first of which is lack of flexibility. Fiberglass honeycomb cannot be laterally compressed enough to be laid in large pieces on the inner skin layer(s) of the radome which are formed of fiber reinforced plastic or pre-preg. Therefore the honeycomb core must be laterally sliced and reassembled in the radome mold. Furthermore, the six-side hexagonal shape of the individual honeycomb open-cell construction also resists compressing when the honeycomb is fitted to the concave contour of the inner radome mold. The stresses created from the fitting process are relieved at right angles and in the opposite direction from the force applied. Therefore, when a craftsman attempts to smooth a section of honeycomb to the concave mold, the edges perpendicular to the contour tend to buckle inward, giving the panel a "saddle" shape. Hexagonal honeycomb core is difficult to mold in two dimensions and impossible to lay down in three dimensions, thus it is all but impossible to lay a hexagonal honeycomb core in the forward nose section, the hemidome, of a radome.

Hybrid Honeycomb Radome Embodiment

Due to the difficulty associated with manufacturing radomes using hexagonal honeycomb in the forward nose, an alternative embodiment will now be described with respect to FIGS. 5A–5D and FIGS. 6–8. As noted above, the fiberglass hexagonal honeycomb configuration provides extremely good strength-to-weight ratios. FIG. 5C illustrates an open-cell configuration of a fiberglass hexagonal honeycomb core 114 as used in the present invention. Although hexagonal honeycomb core 114 is stiff enough to support the air load of commercial aircraft when layered between skins consisting of multiple layers of polymer pre-impregnated fiberglass reinforced mats, problems occur when hexagonal honeycomb is used for the hemidome of the forward nose area. Therefore, a second shape configuration is used in the hemidome. Because of the internal stresses associated with the flat wall construction of the individual cells in the honeycomb core, a flexible core comprising a repeating curve pattern in an offset row-cell configuration can be used.

Figure 5A:
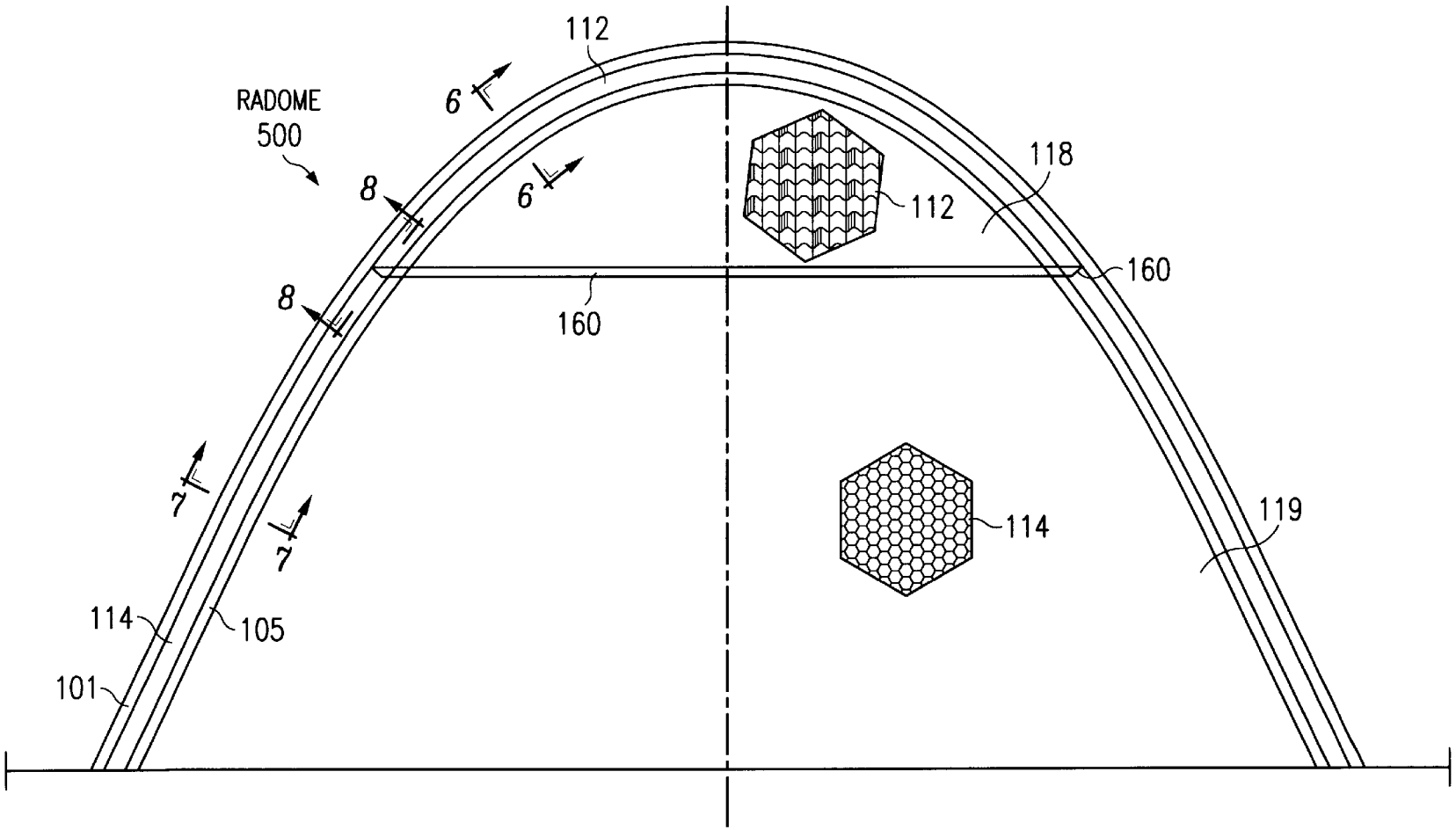
FIG. 5A illustrates a hybrid honeycomb radome embodiment used in the present invention.
Figure 5B:
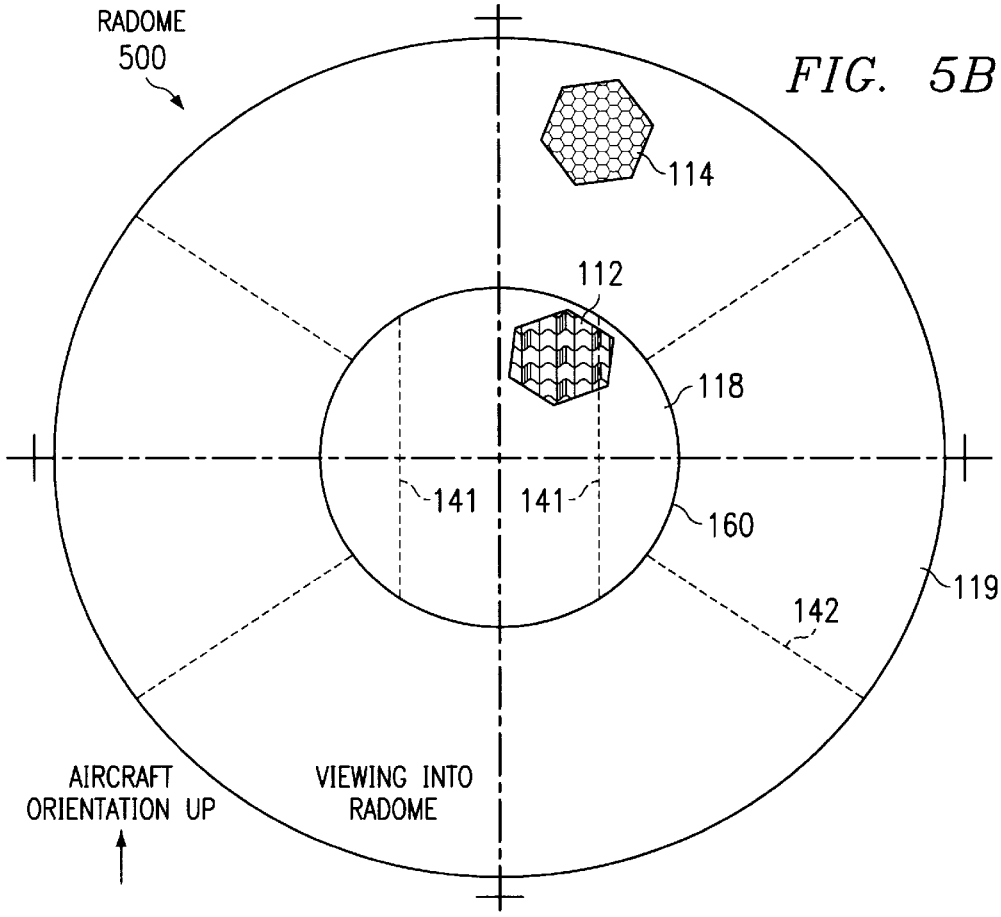
FIG. 5B illustrates a front view of the radome as used in the present invention.
Figure 5C:
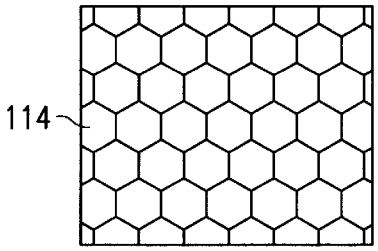
FIG. 5C illustrates an open-cell configuration of a fiberglass hexagonal honeycomb core as used in the present invention.
Figure 5D:
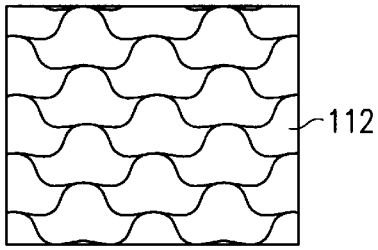
FIG. 5D illustrates a Nomex® flex core as used by the present invention.

FIG. 5D illustrates a Nomex® flex core 112 as used by the present invention. Flex-core or Nomex® flex core 112 provides adequate strength and stiffness when fitted in a two- or three-dimensional mold without developing the internal stresses prevalent with hexagonal honeycomb. Aside from having a different shape from hexagonal honeycomb 114, shown in FIG. 5C, the open-cell construction of flex-core 112 consists of cell openings having over three times the area of the cell openings in hexagonal honeycomb 114, shown in FIG. 5C.

FIG. 5A illustrates a hybrid honeycomb radome embodiment used in the present invention. Radome 500 consists of outer skin 101 and inner skin 105. The core is a hybrid which consists of honeycomb core 114, a 64 kg/m$^3$ density fiberglass hexagonal honeycomb, and flex core 112, an 80 kg/m$^3$ density Nomex® flex core in the nose. Honeycomb core 114 meets flex core 112 at core interface 160.

FIG. 5B illustrates a front view of the radome as used in the present invention. FIG. 5B is oriented to the user with the radome positioned as it would be positioned on an aircraft if the aircraft were facing away from the viewer, or as the user would view into a female radome mold. FIG. 5B illustrates the hybrid core nature of the present invention.

Outer skin 101 of FIG. 5A is formed by laying successive layers of pre-preg in a waxed radome mold. As described before, pre-preg is oriented at a 90° angle from the previous layer rolled in the mold. Alternatively, the orientation of the fibers of successive plies of the pre-preg are arranged in any orientation to optimize the mechanical properties of the radome.

In an alternative embodiment, bagging film (formed of high temperature-resistant plastic) is then placed onto outer skin 101. The mold and outer skin 101 is then cured while a vacuum removes air from between the bagging film and the outer skin. Once the air has been evacuated from the core and the pre-preg, the entire mold and radome are cured at 250°. However, the honeycomb core may be applied directly to the uncured pre-preg of the outer skin.

Once the four oriented layers of the pre-preg are laid down on the radome mold (not shown), the honeycomb core of the radome can be configured from strips of flex core and hexagonal honeycomb. Initially, flex core 112 is fitted into the hemidome shaped forward nose section 118. Note that, even though the Nomex® flex core is extremely pliable, it must still be cut into lengthwise strips for configuring into the hemidome of forward nose section 118.

As shown in FIG. 5B, the number of joints should be limited to two, as can be seen by joints 141. Any gaps in joints 141 between Nomex® flex core strips 112 are filled using potting compound. At this time, interface 160 is formed around flex core 112. Hexagonal honeycomb 112 is then coated with bonding adhesive, cut into interconnecting pie-shaped sections and seated around interface 160. The pie-shaped wedges are much more easily fit into place within the mold. To further reduce buckling between sections in aft section 119, up to two joints 142 may be fashioned in aft section 119. As is done with the flex core seams in joints 141, joints 142 are also filled with potting compound where needed.

Next, hexagonal honeycomb 114 is cut along the outside radial edge in order to form a fit for the edgeband (not shown). An edgeband may be salvaged from each radome that is to be rebuilt, or it may be created by using multiple plies of pre-preg to obtain the required thickness of edgeband laminate. If the edgeband is salvaged, it is cleaned, polished and then fitted into the rebuilt radome. Beforehand, however, any gaps between hexagonal honeycomb 114 and the edgeband are filled with potting compound.

If the pre-preg plies forming outer skin 101 have not been cured, a preferred embodiment requires evacuation of the laminates at this point. A bagging film is then placed onto the honeycomb core. The mold is then cured while a vacuum removes air from between the bagging film and outer skin 101, thus laminating the honeycomb core to outer skin 101. Once the air has been evacuated from the core and the pre-preg, the entire mold and radome are cured at 250°.

Once the honeycomb core has been installed and formed into place, inner skin 105 is formed by orienting three layers of pre-preg. As described before, pre-preg is oriented at a 90° angle from the previous layer rolled in the mold. Alternatively, the orientation of the fibers of successive plies of the pre-preg are arranged in any orientation to optimize the mechanical properties of the radome. Once the three layers have been rolled in the mold, the joint between hexagonal honeycomb 114 and the edgeband (not shown) may be built up using several layers of pre-preg.

Finally, the entire inner surface of radome 500 is covered in a bagging film and then placed onto inner skin 105. The mold is then cured while a vacuum removes air from between the bagging film and the outer skin, thus laminating the honeycomb core to outer skin 105. Once the air has been evacuated from the core and the pre-preg, the entire mold and radome are cured at 250°.

Figure 6:
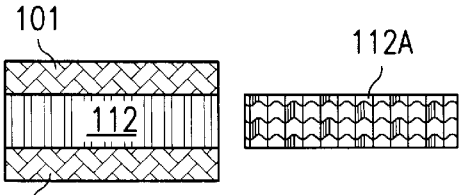
FIG. 6 shows section G–G' of the hemidome shaped forward nose section of the radome.

Cross section G–G' of completed radome 500 is illustrated in FIG. 6. Section G–G' is taken from the hemidome shaped forward nose section 118 and consists of outer skin 101, Nomex® flex core 112 as positioned in section, Nomex® flex core and inner skin 105. Nomex® flex core 112A is a view taken with respect to the normal surface of the skin.

Figure 7:
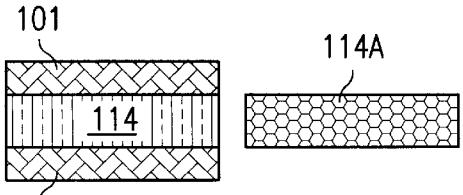
FIG. 7 illustrates cross section E–E' of an aft section of the preferred radome embodiment.

Similarly, FIG. 7 illustrates a cross section E–E' of radome 510 taken from aft section 119. The cross section of FIG. 7 illustrates outer skin 101, hexagonal honeycomb 114, and inner skin 105. Hexagonal honeycomb 114A is a view taken with respect to the normal surface of the skin.

Figure 8:
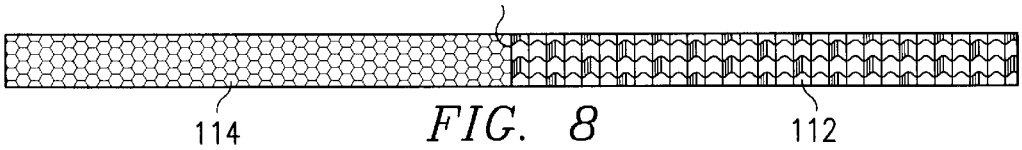
FIG. 8 illustrates a section D–D' taken along the layer of the core and across the interface of the core of the preferred radome.

Finally, FIG. 8 illustrates a section of D–D' taken along the layer of the core and across interface 160. Cross section D–D' shows hexagonal honeycomb 114, Nomex® flex core 112, and interface 116 where two different core configurations abut one another.

Figure 9A:
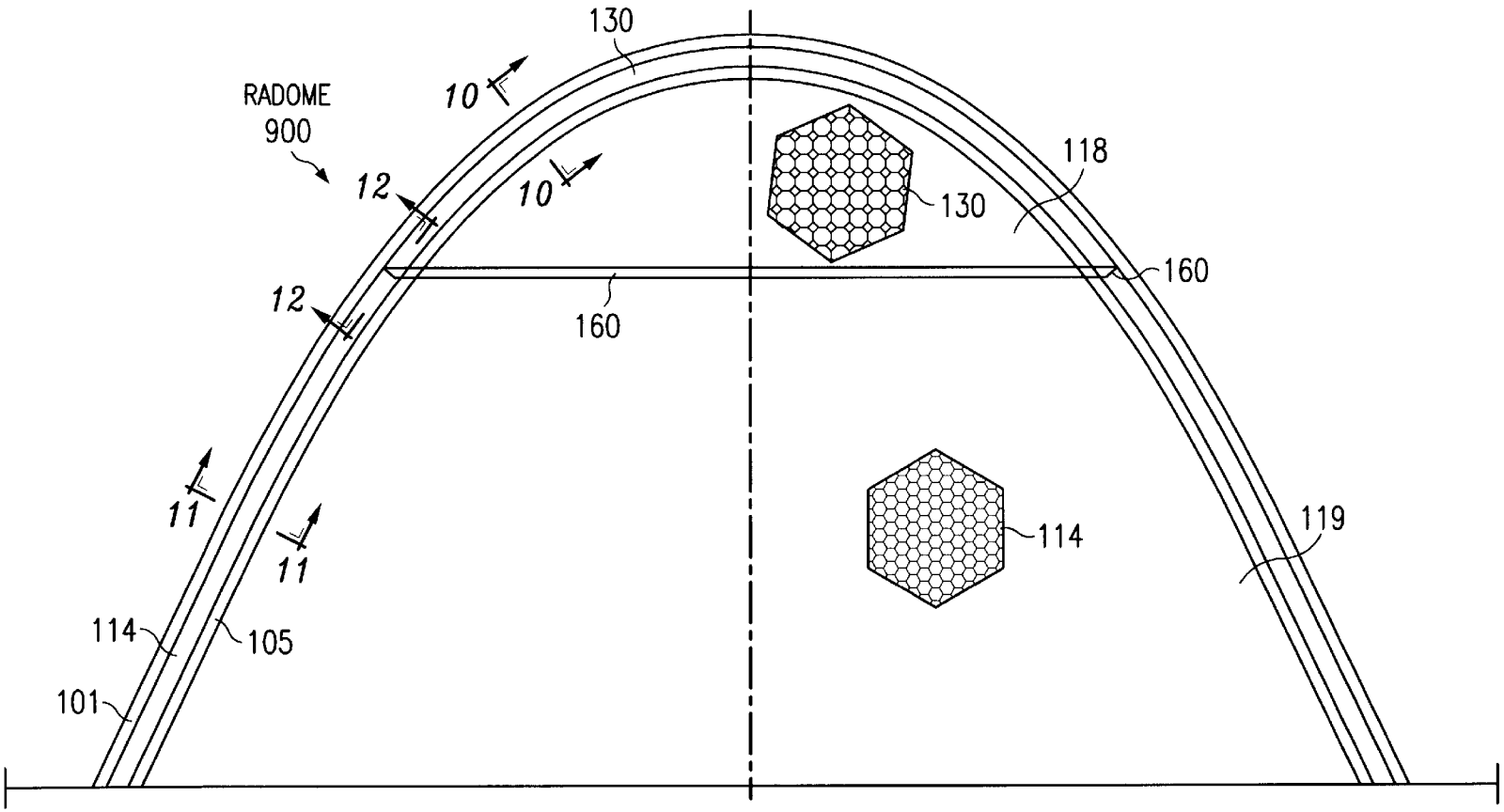
FIGS. 9A and 9B illustrate an alternative hybrid honeycomb radome as used in the present invention.
Figure 9B:
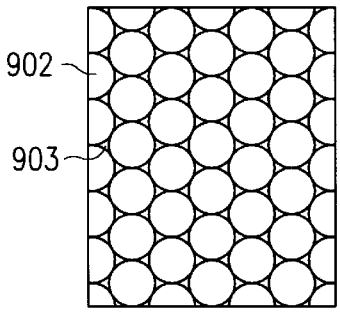

FIG. 9 illustrates another hybrid honeycomb radome as used in the present invention. FIG. 9 is identical to FIG. 5A with the exception that radome 900 uses a polycarbonate honeycomb core 130 in the hemidome nose section, rather than flex core. Polycarbonate honeycomb sold under the trade name of Plascore® is available from Plascore Inc. (615 North Fairview Street, Zeeland, Mich. 49464). Plascore® is not a fiberglass or Nomex® honeycomb; rather, it is formed from a completely different material than that used in the past. Further, as can be seen in FIG. 9B, Plascore® honeycomb 901 is manufactured differently and structured completely differently from honeycombs available in the past.

Rain erosion tests of sandwich samples at Wright Patterson Air Force Base test facility showed Plascore® polycarbonate honeycomb core to provide erosion times to failure of 40 minutes, versus 20 minutes for a foam core sandwich. Using polycarbonate core only in the nose of the radome offers the following advantages. Damages to aircraft radomes are predominantly in the nose. Polycarbonate core, as opposed to Nomex® will resist water migration from cell to cell in a sandwich. Other solvent resistant core materials are used in the aft section of the radome, which is more susceptible to structural failure due to buckling.

The cells of the Plascore® polycarbonate honeycomb core preferably have a diameter in the range of about 3 to about 7 millimeters. The density of the Plascore® polycarbonate honeycomb core is preferably in the range of about 50 to about 150 kilograms per cubic meter.

The Plascore® polycarbonate honeycomb core has temperature rating well suited for high temperature applications, such as those generated by high performance military aircraft, approximately 220° F.

The average dielectric constant is less than 1.2. The loss tangent is less than 0.01, preferably less than 0.005.

FIG. 9B provides a natural image of a cutaway view of a Plascore® polycarbonate honeycomb. Plascore® honeycomb is an open cell honeycomb featuring offset rows of circular shaped primary cells 902 rather than hexagonal cells as in the fiberglass hexagon honeycomb or irregular curved shaped cells as in the Nomex® flex core honeycomb. Similar to the cell arrangement of the prior art honeycomb, Plascore®cells 902 are offset and interlinked with the six adjacent cells. However, unlike prior art honeycomb, due to the circular shape of the Plascore® polycarbonate primary cells 902, small concave triangular secondary cells 903 are formed between primary cells 902. At the intersection of each three circular shaped primary cells 902 resides a triangular shaped secondary cell 903. However, due to the amount of wall contact between adjoining circular shaped cells 902, these small secondary cells 903 do not degrade the overall strength and rigidity provided by the grouping of circular shaped cells in forming the Plascore® polycarbonate honeycomb.

Also different from either the fiberglass hexagonal honeycomb or the Nomex® flex core honeycomb, the Plascore® polycarbonate honeycomb is formed by extruded polycarbonate tubes or straws that are then offset and fused together. Each polycarbonate tube is fused to the six adjacent, surrounding tubes. This manufacturing process is completely different from the manufacturing processes of the two previous honeycombs. In the two previous honeycombs, the individual cells actually start life as a sheet material of fiberglass or Nomex®. The cell walls are formed by alternately linking the sheet material to the adjoining sheets, thus forming cells between the individual sheets of material. The individual honeycomb cells of the prior art, which are formed from two individual sheets of wall material do not possess the individual cell integrity of the Plascore® cells which are unbroken cell walls fused together to form the honeycomb structure. Therefore, the two-sheet configuration has a tendency to tear at the joints or between the two sheets that comprise the cell under extreme stress conditions.

Another problem with the prior art honeycomb is that the cells are configured primarily to expedite the manufacturing process and take advantage of the strength of a honeycomb section as a macro entity, rather than to focus on strength and rigidity at the individual cell level. Thus, cell integrity is compromised when forces which are exerted coaxial to the open cell are absorbed in the cell and transformed radially outwardly toward the cell walls. On the other hand, the unique circular shape of Plascore® polycarbonate honeycomb cells has the advantages of economy of material and being the best geometric configuration to withstand outward or inward radial forces. Therefore, due to the shape and one-piece cell configuration of the individual Plascore® polycarbonate cells, as axial forces are applied to individual cells, the resulting radial component forces are absorbed without the shape deformation or wall separation that are more common in prior art designs such as fiberglass hexagonal honeycomb or Nomex® flex core honeycomb.

The Plascore® honeycomb is made of polycarbonate tubes. While the polycarbonate tube configuration of the honeycomb is strong, it testing has revealed that it is somewhat susceptible to solvent erosion, therefore the most advantageous placement of polycarbonate honeycomb is in the forward nose of the radome. The polycarbonate core, as opposed to Nomex®, tends to resist water migration from cell to cell in a sandwich.

Returning to FIG. 9A, radome 900 consists of outer skin 101, inner skin 105, and a core layer there between. The core layer of radome 900 is of the hybrid design where hemidome shape forward nose 118 core layer 130 is comprised of plascore® polycarbonate honeycomb. In aft section 119, core layer 114 is comprised of standard fiberglass hexagonal honeycomb and is abutted to the hemidome nose layer at interface 160.

Radome 900 is formed in a similar manner as described above with respect to FIGS. 5A and 5B. Outer skin 101 is formed by laying successive layers of pre-preg in a waxed radome mold. As described before, pre-preg is oriented at a 90° angle to the previous layer rolled in the mold. Alternatively, the orientation of the fibers of successive plies of the pre-preg are arranged in any orientation to optimize the mechanical properties of the radome.

In an alternative embodiment, bagging film (formed of high temperature-resistant plastic) is then placed onto outer skin 101. The mold and outer skin 101 are then cured while a vacuum removes air from between the bagging film and the outer skin. Once the air has been evacuated from the core and the pre-preg, the entire mold and radome are cured at 250°. However, the honeycomb core may be applied directly to the uncured pre-preg of the outer skin.

Once the four oriented layers of the pre-preg are laid down on the radome mold (not shown), and the outer skin is cured, the honeycomb core of the radome can be configured from Plascore® polycarbonate honeycomb core and wedges of hexagonal honeycomb core. The inner wall of outer skin 101 and the core may be coated with bonding adhesive, such as AF163-2 epoxy from 3M or M2555 cyanate ester adhesive and the like. Initially, Plascore® polycarbonate honeycomb core is used as core layer 130 in hemidome shaped forward nose section 118. Plascore® polycarbonate honeycomb core is fitted into forward nose section 118. Note that polycarbonate honeycomb may be thermoformed and may not need to be cut into lengthwise strips for configuring into the hemidome of forward nose section 118. Interface 160 is formed around Plascore® polycarbonate honeycomb core 130. Hexagonal honeycomb 112 is then installed, as is inner skin 105 as described above.

Figure 10:
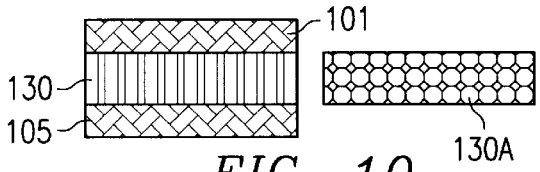
FIG. 10 illustrates a cutaway section G–G' of the hemidome nose section of the radome.

FIG. 10 illustrates a cutaway of hemidome nose section 118 at section G–G'. There, core layer 130 consisting of open circular shaped cells of Plascore® polycarbonate honeycomb is sandwiched between an outer skin 101 and inner skin 105. Plascore® polycarbonate honeycomb core 130A is a view taken with respect to the normal surface of the skin.

Figure 11:
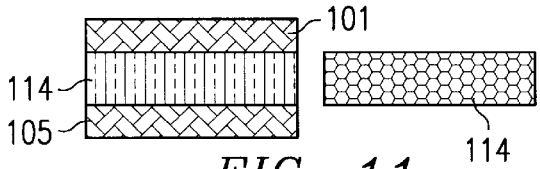
FIG. 11 illustrates a cutaway section E–E' of an aft core section layer comprised of standard hexagonal honeycomb.

FIG. 11 illustrates the aft layer section at cutaway E–E' where core section 114 which is comprised of standard hexagonal honeycomb is sandwiched between outer layer 101 and inner skin layer 105. Hexagonal honeycomb core 130A is a view taken with respect to the normal surface of the skin.

Figure 12:
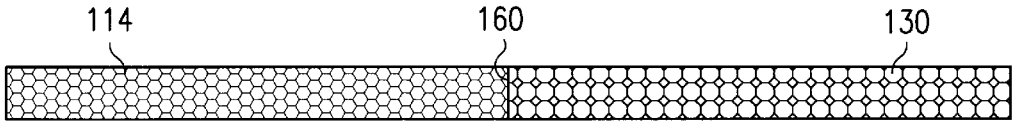
FIG. 12 illustrates a cross section D–D' straddling an interface where the forward nose section of the radome abuts the aft section of the radome.

FIG. 12 illustrates cross section D–D' straddling interface 160 where forward nose section 118 abuts aft section 119.

There, core layer 130 in forward nose 118, which is comprised of plasticore® polycarbonate honeycomb, abuts standard hexagonal honeycomb core layer 114 at interface 160.

Radome 900 can be manufactured in essentially the same manner as described above. In another embodiment, due to the unique manufacturing process and structure of the Plascore® polycarbonate honeycomb, the construction of hemidome shaped core layer 130 need not be by laying preformed flat sheets as described above. While the polycarbonate honeycomb can be cut and laid into the mold, or thermoformed to lay in the mold, the polycarbonate honeycomb can also be hemidomally shaped into that of the radome forward nose 118 using a standard CAD-CAM shaping operation. Thus, rather than the cell axes being aligned perpendicular to the adjacent outer skin, the cell axes align parallel to the axial direction of the front of the radome. Therefore, the greatest strength component of the honeycomb is brought to bear directly in line with the incidence of the impacting objects. This provides a tremendous advantage against impacting objects, such as hail, insects and birds.

Dual Foam Hybrid Radome Embodiment

Figure 13:
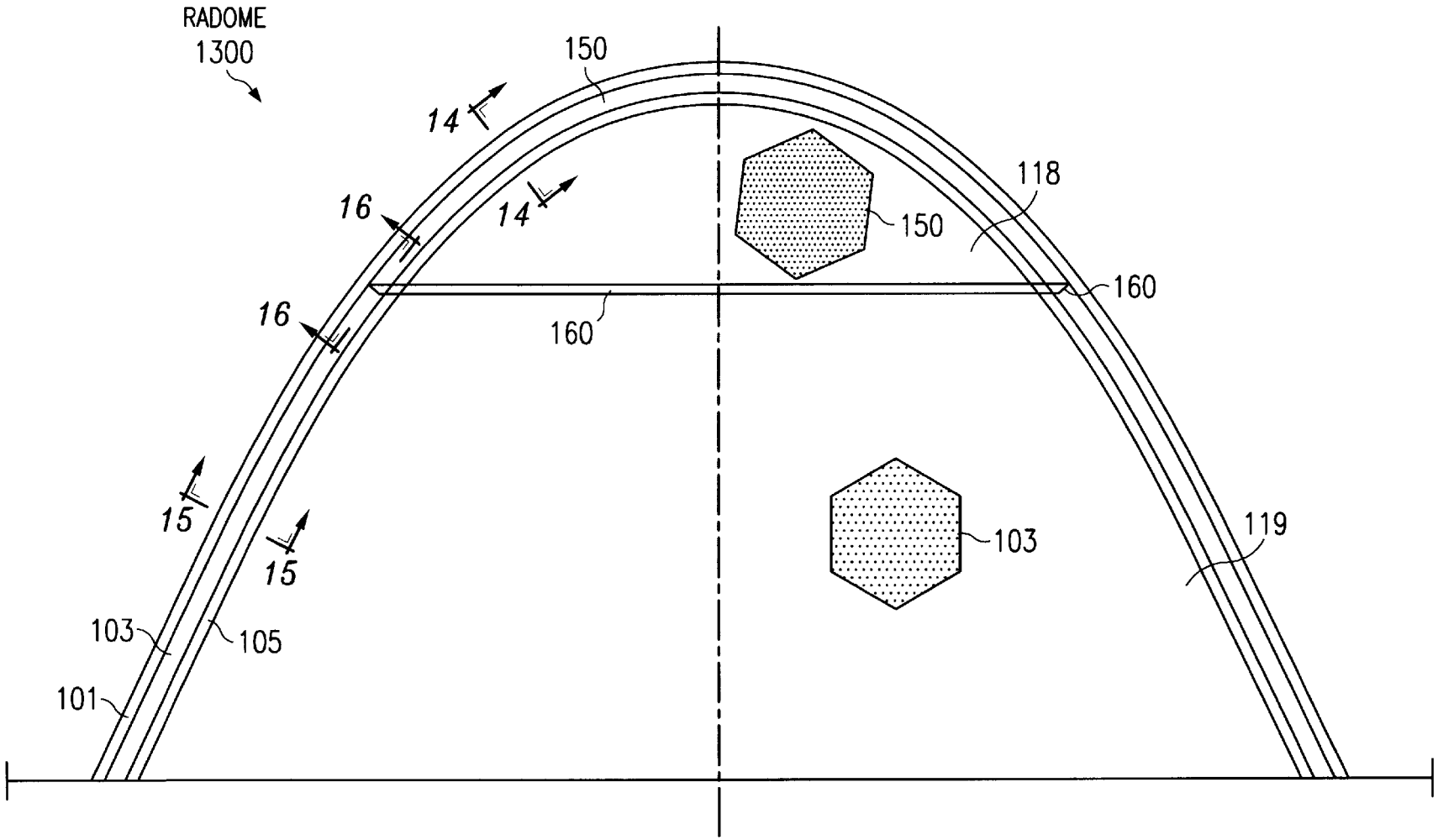
FIG. 13 illustrates a dual foam hybrid radome embodiment of the present invention.

FIG. 13 illustrates a dual foam hybrid radome embodiment of the present invention. Radome 1300 is similar to radome 500 in that it is a hybrid composite of two inner cores, the first inner core comprising forward nose section 118 of radome 1300, and a second inner core comprising aft section 119 of radome 1300, the two being joined at interface 160.

As discussed above, the hybrid construction of radomes has been heretofore strictly a function of manufacturing processes and radome stiffness requirements. No consideration was previously given to constructing a hybrid radome on the basis of impact resistance of the radome so as long as the stiffness requirements for wind resistance and the like were met by the construction of the hybrid radome. Thus, while a hemidome forward nose core layer may consist of a heavier density honeycomb or flex core, the increase in density is not intended to give the radome more strength but, rather, to maintain the overall stiffness the radome needs for wind resistance when shaped as a hemidome. In fact, due to the size and shape of the cell openings in honeycombs such as flex core, their impact resistance is somewhat diminished because the distance between rigid cell walls is much greater than in single foam radome construction. Thus, the tendency of the outer skin to crack is greatly increased.

As also noted above, the Nomex® flex core construction is highly vulnerable to freeze-thaw expansion breakage due to water filling the cells from microcracks in the outer skin. Therefore, although hybrid radomes may have previously been known, the construction of hybrid configurations was strictly dictated by the manufacturing processes and materials available to the manufacturers.

Radome 1300 consists of outer skin 101, a hybrid inner core consisting of a hemidome shaped forward nose 118 including foam layer 150, and an aft foam core 103. Aft section 119 foam core 103 may consist of a polymeric alloy of cross-linked polymide-urea and a linear vinyl polymer, such as in Divinycell™, or standard polymide foam as described above. However, forward nose 118 foam core layer 150 is comprised of a class of foams heretofore unknown in radome construction. These foams include unfilled and glass fiber filled liquid crystalline and semicrystalline polymers (LCPs and PPS). Exemplary polymers are Vectra® by Hoechst Celanese, Chatham, N.J. and Xydar® by Amoco Performance Products, Inc., Alpharetta, Ga. both examples of liquid crystalline polymers and Poly-X™ by Maxdem Incorporated, San Dimas, Calif., a rigid-rod type polymer. Conventional processing techniques for rigid closed-celled foams involve multiple steps using blowing agents to foam the polymers. A process has developed form converting LCPs and PPS into high-temperature microcellular foams with surprisingly high strengths. The foaming technique uses the principle of thermodynamic instability with nitrogen as the foaming gas. Both the unfilled and filled liquid crystalline and semicrystalline polymers (LCPs and PPS) can be foamed, both of which have excellent strength and stiffness-to-weight ratios, good solvent resistance, good barrier properties, and high temperature stability. These foams are available from Wright Materials Research Co. located in Dayton, Ohio.

The blowing process can be used or disperse to align glass and/or silica (quartz) and/or silicate fibers in the foamed matrix. It has been demonstrated for amorphous polymers that the properties of microcellular foams are similar to their solid counterparts. These low-density microcellular LCP and PPS foams have tensile strength in the range of 20 to over 30 ksi. These microcellular foams have been shown to have much higher temperature stability and mechanical properties than those of the commercially available structural foams, including Rohacell™ and Divinycell™. PPS and LCP foams have continuous use temperatures up to 220° C. (428° F.) and 220–270° C. (428–518° F.), respectively.

The cells of these high-temperature microcellular foams preferably have a diameter in the range of about 1 to about 200 microns. The density of the high-temperature microcellular foams are preferably in the range of about 50 to about 150 kilograms per cubic meter. However, cell diameters in the macrocellular range, over 200 microns, also exhibit exceptional strength and stiffness.

The high-temperature microcellular foams have temperature rating well suited for high temperature applications such as those generated by high performance military aircraft, approximately 350° F. The average dielectric constant is less than 1.4. The loss tangent is less than 0.015, preferably less than 0.005.

This class of microcellular LCP, PPS foam as well as the microcellular rigid-rod have excellent strength and stiffness-to-weight ratios, good solvent resistance, and good barrier properties. It is also extremely stable at higher temperatures. Additionally, these foams enable a blowing process that aligns glass and carbon fibers along the stress points of the foam matrix. Thus, the microcellular foams have a tensile strength in the range of 20 to 30 kilograms/in$^2$.

It is also important to note that this new class of microcellular foam has a much higher temperature rating than previous foams such as Rohacell™ and Divinycell™. PPS and LCP foams have a continuous use temperature of up to 220° C. (428° F.) and between 220° and 270° C. (428° to 518° F.). While commercial rated radomes are not normally subjected to such high temperatures, radomes designed for special purpose uses, such as missiles and spacecraft, would benefit from this higher temperature rating.

Another significant benefit of the high temperature rating is realized in the heat curing of the adhesives and skins of radomes. Presently, the temperature ratings of standard foams do not limit the heat curing process of the common pre-pregs. In the future, however, it is expected that curing temperatures may increase due to use of advanced adhesives and polymers in the skin. Therefore, the selection of an inner core foam might dictate which skin components can be used due to the heat curing process. Microcellular foams of the present invention can withstand a much higher range of temperatures in the curing process than previously used foams.

Finally, the foam blowing process allows for the addition of fibrous and particulate material such as glass, silica (quartz) and silicate which greatly increases the impact resistance and stiffness of the core foam material.

Importantly, radome 1300 may include non-fore core material also, for instance nose section core material 150 may be comprised of Plascore® polycarbonate honeycomb rather than a foam core.

In still other alternative embodiments, radome 1300 may consist of a single foam core layer as embodied above with respect to FIGS. 1 and 3 where the foam core is that of the high-temperature microcellular LCP or PPS foams mentioned above, or a macrocellular LCP or PPS foam core, or a micro- or macrocellular rigid-rod type of foam. The foam matrix core may include strengthening agents such as glass (silica) and/or quartz fibers.

The process of manufacturing radome 1300 is similar to that described above with respect to the foam radome in FIGS. 1 and 3 and will not be described again. Likewise, the process of constructing a hybrid radome was discussed above in detail with respect to FIGS. 5A, 5B and 9A and will not be described again.

Figure 14:
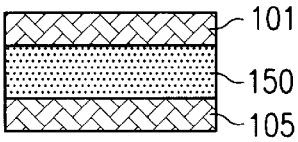
FIG. 14 represents a cross section G–G' in the hemidome shaped forward nose section of the radome.

FIG. 14 represents a cross section at section G–G' in hemidome shaped forward nose section 118. There, foam layer 150 consisting of a microcellular foam from a class of unfilled and filled liquid crystalline and semi-liquid crystalline polymers, or a microcellular rigid-rod type foam, is sandwiched between outer skin layer 101 and inner skin layer 105.

Figure 15:
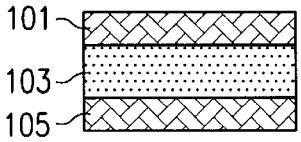
FIG. 15 illustrates a cross section E–E' of the aft section of the preferred radome.

FIG. 15 illustrates cross section E–E' at aft section 119. There, foam core 103 which may consist of a conventionally used foam is sandwiched between outer skin 101 and inner skin 105.

Figure 16:
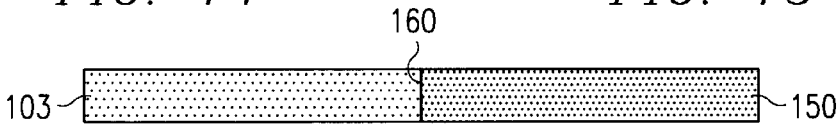
FIG. 16 illustrates cross section D–D' which illustrates the interface between conventional foam layer 103 in aft section 119 and microcellular foam layer 150 in nose section 118 at interface 160.

FIG. 16 illustrates cross section D–D' which illustrates the interface between conventional foam layer 103 in aft section 119 and microcellular foam layer 150 in nose section 118 at interface 160.

Layered Core, Dual Foam Hybrid Radome Embodiment

Figure 17:
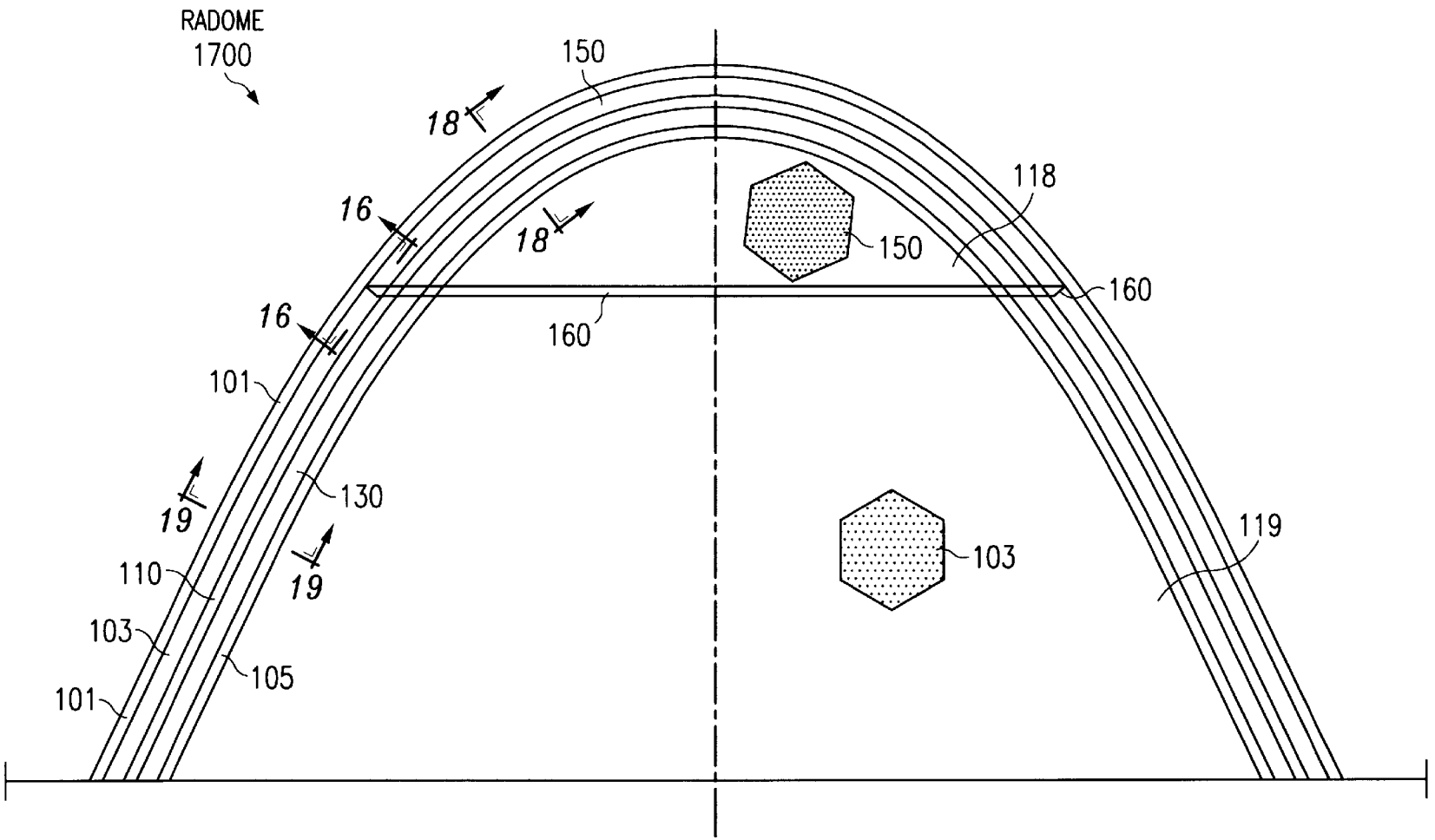
FIG. 17 illustrates a layered core, dual foam hybrid radome embodiment of the present invention.

FIG. 17 illustrates a layered core, dual foam hybrid radome embodiment of the present invention. Radome 1700 illustrates a layered core radome with at least one hybrid core layer. The first three layers of radome 1700 are essentially the same as that described above with respect to radome 1300 and, as such, will not be described in detail again.

Radome 1700 consists of an outer skin layer 101 and a hybrid inner foam core consisting of a hemidome shaped forward nose section 118 foam core layer 150 which is comprised of one of the microcellular class of foams. Radome 1700 further comprises aft section 119 foam core layer 103 which may be comprised of a conventional polymide foam, or a polymuric alloy of cross-linked aeromatic polymide-urea and a linear vinly polymer, such as Divinycel™, or even polymethacrylimide. The hybrid foam core is then sandwiched between an outer skin 101 and intermediate skin 110. Alternatively, core layer 150 may be comprised of Plascore® polycarbonate honeycomb rather than a microcellular class of foam.

Figure 18:
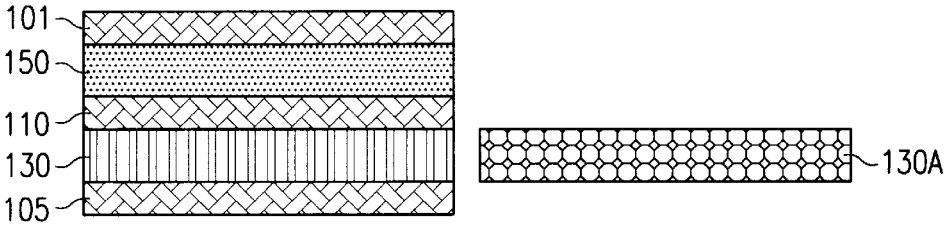
FIG. 18 illustrates cross section G–G' from the hemidome shaped forward nose section 118.
Figure 19:
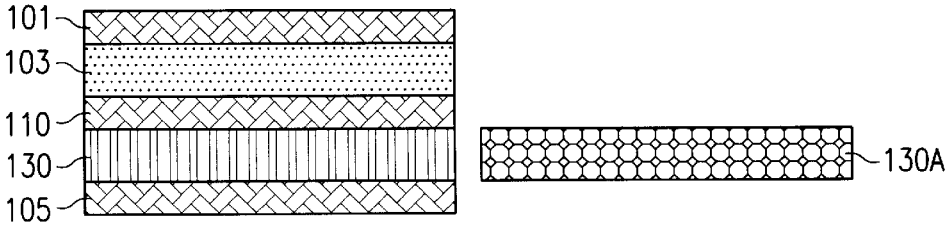
FIG. 19 illustrates a cutaway view of cross section E–E' from aft section 119 of radome 1700.

Next, a second core layer 130 is applied to intermediate skin 110. The process for laying the second core layer is identical to the construction of a core layer as described above. The second core layer can be any one of the honeycombs described above, other than Plascore® polycarbonate honeycomb because of its poor solvent resistance properties it is most practical for the nose section only. However, a circular cell honeycomb comprised of a solvent resistant material would be a good choice in addition to the conventional hexagonal honeycomb. Core layer 130 and 130A in FIGS. 18 and 19 illustrate a circular cell honeycomb although the hexagonal honeycomb is the convention. Foam core Inner skin 105 is then laid over second core layer 130.

FIG. 18 illustrates cross section G–G' from the hemidome shaped forward nose section 118. Cross-section G–G' consists of outer skin 101, foam core 150 which is comprised of one of the microcellular class of foams, and intermediate skin 110. Next, second core layer 130 which is comprised of honeycomb is sandwiched between intermediate skin layer 110 and inner skin layer 105. Honeycomb core 130.A is a view taken with respect to the normal surface of the skin of a circular cell honeycomb, but hexagonal honeycomb is also suitable.

FIG. 19 illustrates a cutaway view of cross section E–E' from aft section 119 of radome 1700. There, outer skin 101 covers foam core 103 which is comprised of one of the conventionally listed foams such as polymide foam, or a polymuric alloy of cross-linked aeromatic polymide-urea and a linear vinyl polymer, such as Divinycell™, or even polymethacrylimide. Foam core layer 103 is covered by intermediate skin 110 which is supported by honeycomb core layer 130. Honeycomb core 130 is a polycarbonate honeycomb covered by inner skin 105. Circular cell honeycomb core 130A is a view taken with respect to the normal surface of the skin.

The description of the present invention has been presented for purposes of illustration and description, but is not intended to be exhaustive or limited to the invention in the form disclosed. In other embodiments, any impact resisting core is positioned at the forward nose section of the radome while the conventional core material is positioned in the aft section of the radome as no such radome has been heretofore devised. The forward nose core is chosen for impact damage resistance properties only and not for manufacturing ease. The nose of the hybrid radome be polycarbonate honeycomb, liquid crystal polymer microcellular foam, or any foam imparting impact resistance to the nose, unfilled and glass fiber filled liquid crystalline and semi-crystalline polymers whether a micro- or macrocellular foam or a rigid-rod polymer class of foams having the same cellular size. The aft body core is different from the nose core, less impact resistant. It may be Nomex® honeycomb, glass fiber honeycomb, Airex polyetherimide foam, PES (polyethersulfone) foam, or DAIB Divinycel™ foam. This core may be chosen for low cost, strength and stiffness, environmental resistance, or any combination of reasons making it a different choice from the nose core. Additionally, any of the above might be combined with fibrous or particulate matter in order to further increase the impact resistance of the radome nose. More importantly, the use these polymers in foam form is unknown in radomes, the inclusion of these foams in the hybrid radome construction is similarly unknown. Finally, polycarbonate honeycomb is likewise unknown to hybrid radome construction as is the combination of polycarbonate honeycomb, such as Plascore® with any of the above mentioned foam cores in a hybrid configuration.

In still another embodiment of the present invention, the foam blowing process described above allows for the addition of fibrous and particulate material such as quartz and glass which greatly increases the impact resistance and stiffness of (imidized thermoplastic polymers) core foam materials. Thermoplastic polyimide foam cores such as polyetherimid benefit from the addition of glass or silica (quartz) or silicate fibers increasing their overall stiffness and to some degree, their impact resistance. The stiffness of polyethersulfone core foams is likewise increased from the addition of fibrous and particulate material such as quartz and glass. Therefore these foams combined with fibrous and particulate materials which were heretofore unknown in radome construction, make ideal aft section core material, for instance as shown in FIG. 13, core foam 103.

In an alternative embodiments, radome 1300 may consist of a single foam core layer as embodied above with respect to FIGS. 1 and 3 where the foam core is that of the high-temperature microcellular LCP or PPS foams mentioned above, or a macrocellular LCP or PPS foam core, or a micro- or macrocellular rigid-rod type of foam. The foam matrix core may include strengthening agents such as glass and/or silica (quartz) and/or silicate fibers or particles.

Determining the Position of the Interface Between the Nose and Aft Sections

Figure 20:
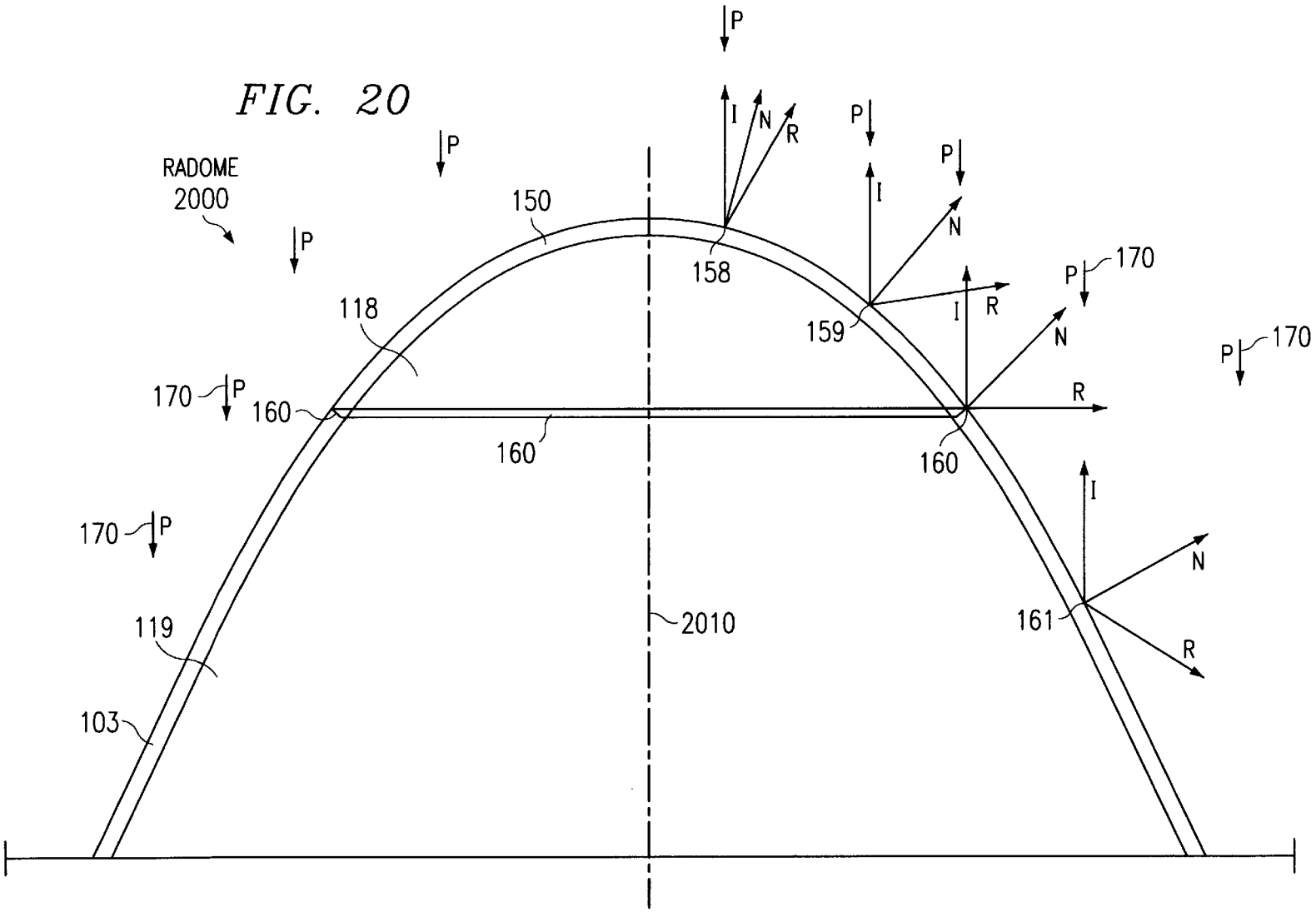
FIG. 20 also shows the path of airborne objects 170 as would be encountered by a radome in flight.

As noted above, until now, manufacturing aspects dictated the placement of interface between the core layer in the forward nose section and the core layer in the aft section of a hybrid radome. FIG. 20 illustrates considerations in positioning the interface within a hybrid radome. Radome 2000 consists of a hemidome shaped forward nose cone 118 and core layer 150. For this embodiment, core layer 150 may consist of any core material described above or any core material available in the future. Aft section 119 contains core layer 180 which is separated from core layer 150 by interface 160. Heretofore, interface 160 was dictated by the mechanical properties of the particular core materials being applied in the manufacturing process. Thus, interface 160 was normally dictated by the amount of flex in the fiberglass hexagonal honeycomb.

FIG. 20 also shows the path of airborne objects 170 as would be encountered by a radome in flight. Note that the path of airborne objects 170 is parallel to the direction of travel because, generally, the aircraft flies into the objects. Vector groups at surface points 158, 159, 160 and 161 represent the incidence and reflection components of an impact force at points along radome 2000 with respect to the normal surface of the skin at that point. For example, at point 158, near the front of hemidome forward nose section 118, object 170 strikes radome 2000 with an incidence of 0°, or parallel to forward pointing orientation vector 2010. The normal of point 158 is 10°, which results in a 20° calculated reflection component. Thus, whatever the maximum amount of energy that particle 170 has available to transmit to radome 2000, 98.5% of the total amount will be transmitted due to the angle of the outer skin at the point of impact. Any object impact at a surface point having a normal of 10° would be expected to transmit 98.5% of its available energy to the radome. Point 159 has a normal of 30° and 86.6% of an object's energy would be expected to transfer to radome 2000 on impact. Point 160, which is located at interface 160, has a normal of 45° and 70.7% of an object's energy would be expected to transfer to radome 2000 on impact. All points having a normal of 45° would expect to receive 70.7% of an object's available energy upon impact, thus all points around interface 160 would receive 70.7% of an object's available energy. Point 161 has a normal of 60°, and 50.0% of an object's energy would be expected to transfer to radome 2000 on impact at that point. As can easily be seen, the greater the angle of impact between the surface and the path of the object, the less the amount of energy a particle can transmit to the radome. Therefore, the need for a highly impact resistant core diminishes as the point of impact moves away from the hemidome forward nose section 118 and toward aft section 119. As highly impact resistant core materials are extremely expensive as compared to conventional core materials, selecting the most advantageous position for an interface allows for maximum impact resistance where needed, as well as reduction in the cost of the protection.

Determining the position of interface 160 between hemidome forward nose section 118 core layer 150 and aft section 119 core layer 180 is best referenced by the perimeter contours around radome 2000. These contours are defined by a closed group of points all having identical normal surface orientations with respect to forward pointing orientation vector 2010. The problem of determining a precise location for interface 160 is essentially a cost/benefit analysis involving the ratio of the benefits derived from the fore and aft cores versus a ratio of the cost of using the fore and aft cores. Positioning of the interface is herein described specifically in regard to a foam core interface; however, the process is equally valid for radome cores other than foam.

Although there is clearly a benefit derived from the use of one core material versus another with regard to resilience against impact with airborne objects, this benefit must be quantifiable from one core to another. The absolute strength ratings of foam core materials are readily available from the manufacturers or distributors of the products. However, a problem occurs in that there is no one-to-one correlation between strength and impact resistance. There is a corollary between the two, but it is not linear and it varies depending on a number of factors in the radome construction process.

A better indicator of core material strength in impact testing is a measurement of the total impact energy required to crack or disintegrate the core material with the fiberglass skins in place. An even better indicator of the strength of a core material is the repetitive impact test in which the core is subjected to a set number of measured impacts. The impact energy at which the core is compromised is then measured and can be used to compare one core material to another.

The cost of using foam core involves not merely the cost of purchasing foam core material, but also includes the added cost (or benefits) associated with the use of foam in the manufacturing process, as well as its affect on the lifetime of the radome. Therefore, the costs associated with warranted repairs, if any, and any benefits derived from the longevity of the material, or lack thereof, should also be factored into the cost ratios. Costs should be measured on a per-unit basis, as nearly as possible, rather than on an actual basis, in order to compare like entities. The intent is not to choose one foam core over another, but to determine where the optimum location of interface 160 occurs on radome 2000, in order to maximize both cost efficiency and benefits to be derived from a mixed use embodiment.

Generally, interface 160 occurs between the 30° normal perimeter and the 60° normal perimeter of a hybrid radome. As discussed earlier, prior to the present invention, the position of interface 160 was strictly a function of the manufacturing process. Fiberglass hexagonal honeycomb was laid into a mold up to a position where the rate of change of contour becomes too great for hexagon honeycomb. That perimeter determined the interface between the core layer in the forward nose section and the core layer in the aft section. Of course, the process was not repeated on each successive radome once the position of the interface became known.

New generation foams, such as the above-mentioned microcellular class of foams, in addition to polymide (imidized thermoplastic polymer) foams, polymeric alloys of a cross-linked aromatic polyamide-urea and a linear vinyl polymer, such as Divinycell™ and Rohacell (polymethacrylimide) from Rohm Teca, can now be positioned anywhere within radome 2000 because of the added strength and flexibility of the new foam core material. Therefore, the position of interface 160 within the hemidome becomes a question of economics rather than manufacturing techniques.

The interface which defines the perimeter of the hemidome with respect to direction vector 2010 of the forward axis of radome 2000 is given as:

$$\text{Normal of interface}=\text{Tan}^{-1}[((S_{N'}/S_{A'})-X)^{(Y\cdot(Ca/Cn))}]$$

where, $S_{A'}$ is the strength of the aft core material;

$S_{N'}$ is the strength of the forward nose core material;

$C_a$ is the normalized cost associated with using the aft core material;

$C_n$ is the normalized cost associated with using the forward nose material: and X and Y are scalars parameters used for setting the relative importance of strength or cost.

An example is using two foams, the first having a measured impact failure energy of 4.5 n-m and the second foam designated for the radome having 1.08 n-m measured impact failure energy. The normalized cost associated with manufacturing a hybrid radome using the first foam is 20% of the entire manufacturing cost, while using the second foam requires 35% of the cost of the radome for the foam. There is some transition cost for constructing a hybrid radome over a conventional radome so, in this example, a value of 1.0 is selected for X and the default value of 1.0 is selected for Y. Therefore, the strength of the first foam core must be twice the strength of the second foam core in order for the calculated interface position to exceed the nominal 30° perimeter position for a minimum sized hemidome in a hybrid radome. The position of interface 160, in this example, should be positioned at the 65.12° normal perimeter in order to take advantage of the added strength benefit, given the added cost.

It must be understood that the above example and algorithm are merely examples. Many other configurations could be applied to determine the optimum interface between the hemidome forward nose core and aft section core based on strength parameters, without departing from the scope or spirit of this embodiment.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A hybrid radome comprising:

a skin layer;

a core layer, the core layer comprising:

a first core material, the first core material having first impact resisting properties; and a second core material, the second core material having second impact resisting properties, wherein the second core material is chosen for the second impact resisting properties over the first impact resisting properties of the first core material and further wherein at least one of the first core material and the second core material comprises one of a microcellular liquid crystal polymer foam and a microcellular rigid rod polymer foam each having a density between fifty and one hundred and fifty (50–150) kilograms per cubic meter; and an interface separating the first core material from the second core material.

2. The radome recited in claim 1, wherein the position of the interface on the radome is determined comparing the second impact resisting properties of the second core material with the first impact resisting properties of the first core material.

3. The radome recited in claim 1, wherein the first core material or the second core material are foam which include one or more types of strengthening agents including: glass, silica, quartz and silicate.

4. The radome recited in claim 3, wherein the strengthening agents are one of fibers or particles being aligned or dispersed.

5. The radome recited in claim 4, wherein the foam comprises one of imidized thermoplastic polymers, imidized thermoplastic polymers, thermoplastic polyetherimid and polyethersulfone.

6. An impact resistant radome comprising:

a first layer, the first layer comprising at least one ply of synthetic woven fiber impregnated with a resin; and a second layer, the second layer comprising a polycarbonate honeycomb core.

7. An impact resistant radome comprising:

a first layer, the first layer comprising at least one ply of synthetic woven fiber impregnated with a resin; and a second layer, the second layer comprising a microcellular foam core, wherein the microcellular foam is one of a microcellular liquid crystal polymer foam and a microcellular rigid rod polymer foam each having a density between fifty and one hundred and fifty (50–150) kilograms per cubic meter.

8. A hybrid radome comprising:

a skin layer;

a core layer, the core layer comprising:

a first core material, the first core material comprising a polycarbonate honeycomb; and a second core material; and an interface separating the first core material from the second core material.

9. The radome recited in claim 8, wherein the first core material having associated first impact resisting properties and the second core material having associated second impact resisting properties.

10. The radome recited in claim 9, wherein the position of the interface on the radome is determined comparing the second impact resisting properties of the second core material with the first impact resisting properties of the first core material.

11. The radome recited in claim 8, the polycarbonate honeycomb comprising:

a plurality of open cells, each of the plurality of cells having a center cell axis, wherein each cell axis being perpendicular to an adjacent point on the skin layer.

12. The radome recited in claim 8, the radome further comprising:

a radome axis, wherein the radome axis is parallel to a direction of motion of the radome; and the polycarbonate honeycomb further comprising:

a plurality of cells, each cell of the plurality of cells having a center cell axis, wherein the cell axis of each cell being parallel to the radome axis.

13. A hybrid radome comprising:

a skin layer;

a core layer, the core layer comprising:

a first core material, the first core material comprising a microcellular foam, wherein the microcellular foam is one of a microcellular liquid crystal polymer foam and a microcellular rigid rod polymer foam each having a density between fifty and one hundred and fifty (50–150) kilograms per cubic meter; and a second core material; and an interface separating the first core material from the second core material.

14. The radome recited in claim 13, wherein the position of the interface on the radome is determined comparing the second impact resisting properties of the second core material with the first impact resisting properties of the first core material.

15. A composite hybrid radome comprising:

a first skin layer;

a first core layer, the first core layer comprising:

a first core material, the first core material having first impact resisting properties; and a second core material, the second core material having second impact resisting properties, wherein the second core material is chosen for the second impact resisting properties over the first impact resisting properties of the first core material and further wherein at least one of the first core material and the second core material comprises one of a microcellular liquid crystal polymer foam and a microcellular rigid rod polymer foam each having a density between fifty and one hundred and fifty (50–150) kilograms per cubic meter;

an interface separating the first core material from the second core material;

a second skin layer; and a second core layer.

16. The radome recited in claim 15, wherein the second core material is comprised of a microcellular foam.

17. The radome recited in claim 15, wherein the second core material is comprised of a polycarbonate honeycomb.

18. The radome recited in claim 15, wherein the position of the interface on the radome is determined comparing the second impact resisting properties of the second core material with the first impact resisting properties of the first core material.

19. The radome recited in claim 15, wherein the first core material or the second core material are foam which include one or more types of strengthening agents including: glass, silica, quartz and silicate.

20. The radome recited in claim 19, wherein the strengthening agents are one of fibers or particles being aligned or dispersed.

21. The radome recited in claim 20, wherein the foam comprises one of imidized thermoplastic polymers, imidized thermoplastic polymers, thermoplastic polyetherimid and polyethersulfone.

22. A composite radome comprising:

a first skin layer;

a first core layer having a first core material;

a second skin layer;

a second core layer, wherein the first core material is chosen for its impact resistance over impact resistance of the second core material and further wherein at least one of the first core material and the second core material comprises one of a microcellular liquid crystal polymer foam and a microcellular rigid rod polymer foam each having a density between fifty and one hundred and fifty (50–150) kilograms per cubic meter, and an interface separating the first core material from the second core material.

23. The radome recited in claim 22, wherein the second core material is comprised of a microcellular liquid crystal polymer foam.

24. The radome recited in claim 22, wherein the second core material is comprised of a polycarbonate honeycomb.

25. The radome recited in claim 22, wherein the first core material having associated first impact resisting properties and the second core material having associated second impact resisting properties.

26. The radome recited in claim 25, wherein the position of the interface on the radome is determined comparing the second impact resisting properties of the second core material with the first impact resisting properties of the first core material.

27. A hybrid radome comprising:

a skin layer;

a core layer, the core layer comprising:

a first core material positioned aft on the radome; and a second core material positioned forward on a nose section of the radome, further wherein at least one of the first core material and the second core material comprises one of a microcellular liquid crystal polymer foam and a microcellular a rigid rod polymer foam each having a density between fifty and one hundred and fifty (50–150) kilograms per cubic meter; and an interface separating the first core material from the second core material.

28. The radome recited in claim 27, wherein the second core material is comprised of a microcellular liquid crystal polymer foam.

29. The radome recited in claim 27, wherein the second core material is comprised of a microcellular semi-crystalline polymer foam.

30. The radome recited in claim 27, wherein the second core material is comprised of a microcellular rigid-rod type of polymer foam.

31. The radome recited in claim 27, wherein the second core material is comprised of a macrocellular liquid crystal polymer foam.

32. The radome recited in claim 27, wherein the second core material is comprised of a macrocellular semi-crystalline polymer foam.

33. The radome recited in claim 27, wherein the second core material is comprised of a macrocellular rigid-rod type of polymer foam.

34. The radome recited in claim 27, wherein the second core material is comprised of a liquid crystal polymer foam.

35. The radome recited in claim 27, wherein the second core material is comprised of a semi-crystalline polymer foam.

36. The radome recited in claim 27, wherein the second core material is comprised of a rigid-rod type of polymer foam.

37. The radome recited in claim 27, wherein the second core material is comprised of a liquid crystal polymer foam matrix containing fiber.

38. The radome recited in claim 27, wherein the second core material is comprised of a semi-crystalline polymer foam matrix containing fiber.

39. The radome recited in claim 27, wherein the second core material is comprised of a rigid-rod type of polymer foam matrix containing fiber.

40. The radome recited in claim 27, wherein the second core material is comprised of a polycarbonate honeycomb.

41. The radome recited in claim 40, wherein the polycarbonate honeycomb is configured with essentially circular primary cells.

42. A radome comprising:

a skin layer;

a core layer, the core layer comprising a core material, wherein the core material comprises a microcellular liquid crystal polymer foam having a density between fifty and one hundred and fifty (50–150) kilograms per cubic meter.

43. The radome recited in claim 42 above wherein cells of the microcellular liquid crystal polymer foam have diameters between 1 and 200 microns.

44. The radome recited in claim 42 above wherein the microcellular liquid crystal polymer foam has a temperature range of from two hundred and seventy degrees Fahrenheit and five hundred and eighteen degrees Fahrenheit (270° F.–510° F.).

45. The radome recited in claim 42 above wherein the microcellular liquid crystal polymer foam an average dielectric constant of less than one and four tenths (1.40).

46. The radome recited in claim 42 above wherein the microcellular liquid crystal polymer foam has a loss tangent of less than fifteen-thousandths (0.015).

47. A radome comprising:

a skin layer;

a core layer, the core layer comprising a core material, wherein the core material comprises a microcellular rigid rod polymer foam having a density between fifty and one hundred and fifty (50–150) kilograms per cubic meter.

48. The radome recited in claim 47 above wherein cells of the microcellular rigid rod polymer foam have diameters between 1 and 200 microns.

49. The radome recited in claim 47 above wherein the microcellular rigid rod polymer foam has a temperature range of from two hundred and seventy degrees Fahrenheit and five hundred and eighteen degrees Fahrenheit (270° F.–510° F.).

50. The radome recited in claim 47 above wherein the microcellular rigid rod polymer foam an average dielectric constant of less than one and four tenths (1.40).

51. The radome recited in claim 47 above wherein the microcellular rigid rod polymer foam has a loss tangent of less than fifteen-thousandths (0.015).

* * * * *